United States Patent [19]

Wohlfeld

[11] 4,016,944

[45] Apr. 12, 1977

[54] PNEUMATIC HAMMER-AUGER EARTH BORING APPARATUS

[75] Inventor: William I. Wohlfeld, San Angelo, Tex.

[73] Assignee: Reed Tool Company, Houston, Tex.

[22] Filed: Jan. 12, 1976

[21] Appl. No.: 648,559

[52] U.S. Cl. ..... 175/92; 175/390; 175/394

[51] Int. Cl.[2] ..... E21B 5/00

[58] Field of Search ..... 175/92, 102, 257, 260, 175/310, 323, 390, 394, 395, 385

[56] References Cited

UNITED STATES PATENTS

| | | | |
|---|---|---|---|
| 942,066 | 12/1909 | Hardsocg | 175/102 |
| 2,938,709 | 5/1960 | Curtis | 175/390 |
| 3,945,444 | 3/1976 | Knudson | 175/257 X |

FOREIGN PATENTS OR APPLICATIONS

| | | | |
|---|---|---|---|
| 1,396,185 | 6/1975 | United Kingdom | 175/394 |

*Primary Examiner*—Ernest R. Purser
*Assistant Examiner*—Richard E. Favreau
*Attorney, Agent, or Firm*—Neal J. Mosely

[57] ABSTRACT

An improved earth boring apparatus for soft, hard, and heterogenous formations utilizes a pneumatic hammer combined with an earth boring auger. The pneumatic hammer is supported inside a hollow case of the auger and has a small pilot bit and a large rigid bit plate having the same diameter as the auger flighting. All torque to the apparatus is supplied to the auger case which drives the flighting and the pneumatic bit plate without applying any torque to the pneumatic hammer case. This arrangement utilizes the pneumatic hammer to break up hard material and the auger to remove the cuttings or to cut through soft material. The drive arrangement allows for disassembly of the pilot bit and bit plate without removing the pneumatic hammer.

10 Claims, 6 Drawing Figures

PNEUMATIC HAMMER-AUGER EARTH BORING APPARATUS

BACKGROUND OF THE INVENTION

1. Field of the Invention

This invention relates to new and useful improvements in earth boring apparatus and more particularly to earth boring augers provided with an auxiliary means for penetrating rocks and other hard formations.

1. Description of the Prior Art

Power driven earth boring augers are commonly used for drilling holes in the earth in soft formations. Augers are used from small sizes of the order of 1 or 2 inches up to large sizes which may be several feet in diameter. Augers are used for drilling holes in soft formations in depths up to about 150 feet. Auger drilled holes are used in foundations for buildings and for other construction purposes and are also used for various types of wells and blast holes.

In drilling through rock and other hard formations, it is ordinarily not possible to use augers. For hard formations, it is necessary to use hard rotary rock drills, roller bits, or rotary pneumatic hammers.

While augers have proven quite effective for drilling soft formations and various types of rock drills are quite effective in hard formations, there has been no generally satisfactory method for drilling through formations that are heterogenous in structure. Thus, if it is desired to drill through a formation which is alternately hard and soft or a soft formation which contains boulders or even smaller rocks or occasional layers of hard material there is no generally satisfactory drilling method available. An auger can be used in the softer formations and then a rock type drill used for drilling through rock or harder formations. This is quite costly and inefficient in operation. There has been a considerable need for a single type of drilling apparatus which will be effective both in soft and harder formations without necessitating frequent changes in the type of drill used.

STATEMENT OF OBJECTS AND FEATURES

One object of this invention is to provide an improvided earth boring apparatus which will bore through soft, hard, and heterogenous formations.

Another object of this invention is to provide an improved earth boring apparatus which will bore through soft formations at a higher rate of penetration and will cut through harder formations without the necessity of changing to a hard rock type drill.

Still another object of this invention is to provide an improved earth boring auger having auxiliary means to penetrate hard formations or rocks encountered in soft formations.

A feature of this invention is the provision of an improved earth boring auger having a rock-penetrating means which will cut through hard formations or rocks with the auger conveying away the cuttings.

Another feature of this invention is the provision of an improved earth boring auger having a rock penetrating bit operated by impact and rotated to penetrate rock or other hard formations with the auger conveying away the cuttings.

Still another feature of this invention is the provision of an improved earth boring auger having a rock penetrating bit operated by a pneumatic hammer positioned within the auger and rotated therewith.

Other objects and features of this invention will become apparent from time to time throughout the specifications and claims as hereinafter related.

SUMMARY OF THE INVENTION

This invention consists of an improved earth boring apparatus which will cut through soft, hard and heterogenous formations. In particular, the apparatus consists of an auger for cutting through soft formations or for conveying away cuttings from hard or heterogenous formations, which is equipped with a pneumatic hammer supported inside a hollow case of the auger and having a small pilot bit and a large rigid bit plate of the same size as the flighting on the auger. The combination auger and hammer is arranged so that the torque is applied only to the auger case which drives the flighting and the pneumatic bit plate and thus carries out the earth boring operations without applying torque to the pneumatic hammer. This arrangement also has the advantage that it allows for disassembly of the pilot bit and the bit plate without removing the pneumatic hammer from the apparatus.

DESCRIPTION OF A PREFERRED EMBODIMENT

Figure 1:
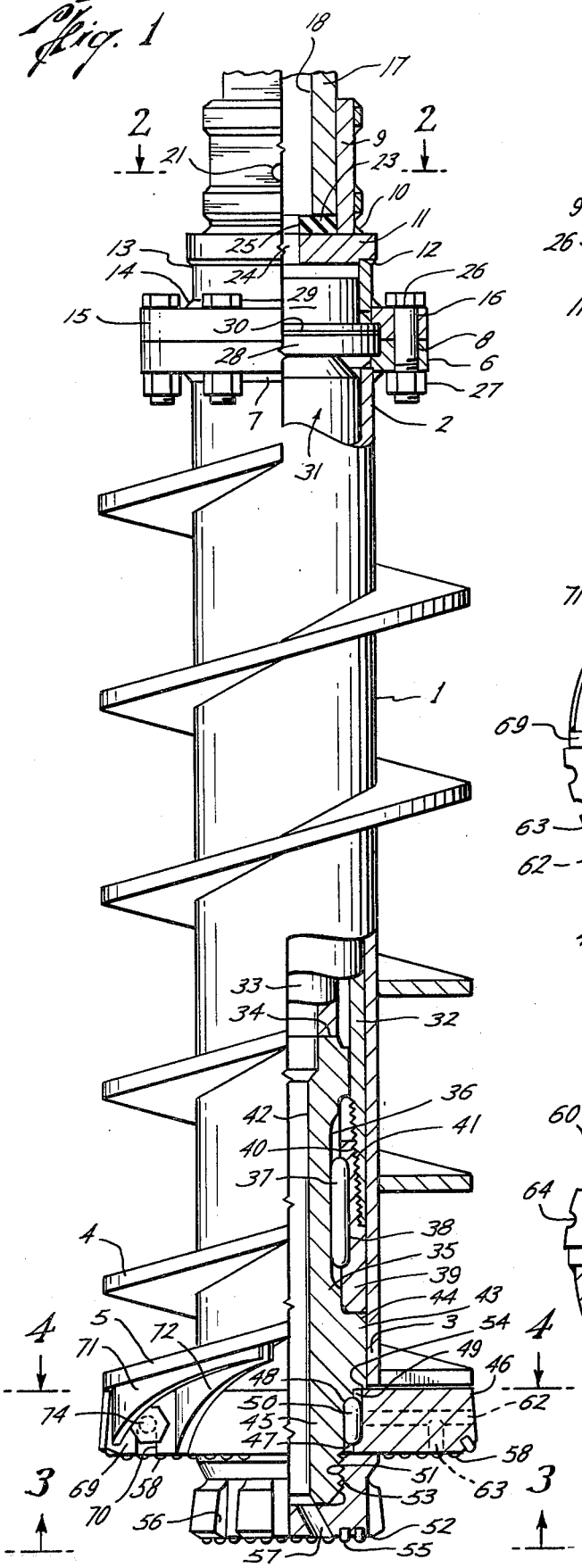
FIG. 1 is a view in elevation of a combined pneumatic hammer and earth boring auger and having partial sections taken at the top and bottom to illustrate certain features of construction.
Figure 2:
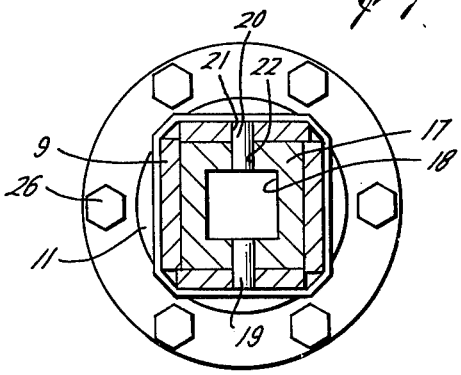
FIG. 2 is a sectional view taken on the line 2—2 of FIG. 1.
Figure 3:
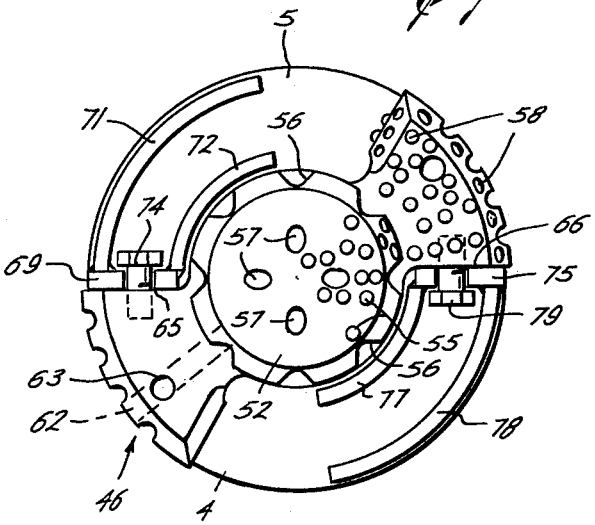
FIG. 3 is an end view of the bottom of the apparatus shown in FIG. 1 as viewed from the line 3—3 of FIG. 1.
Figure 4:
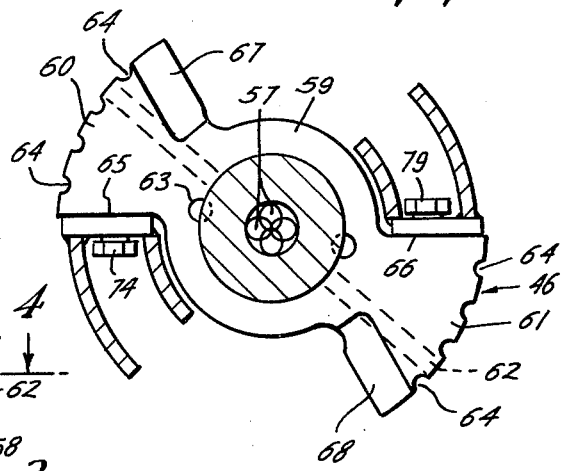
FIG. 4 is a sectional view taken on the line 4—4 of FIG. 1 showing the attachment of the bit plate to the auger flighting.
Figure 5:
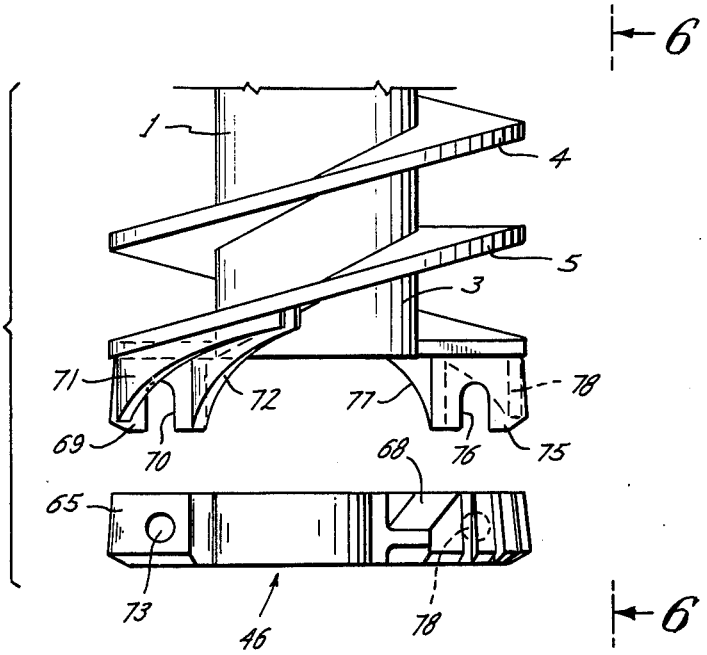
FIG. 5 is a partially exploded view showing the bit plate in association with the lower end of the auger flighting and illustrating the connection therebetween.
Figure 6:
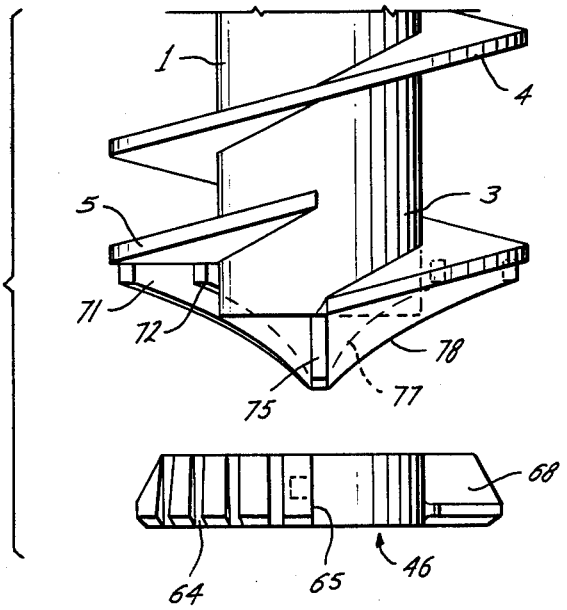
FIG. 6 is an exploded view of the lower end of the auger and the bit plate in association therewith as viewed from the line 6—6 of FIG. 5.

Referring to the drawings by numerals of reference, and more particularly to FIG. 1, there is shown a combined percussion and rotary auger earth boring apparatus sometimes called a pneumatic hammer-auger. The rotary auger has a hollow case 1 with an upper, driven end portion 2 and a lower cutting end portion 3. The auger has a first helical flight 4 which extends helically from the cutting end portion 3 to the driven end portion 2. There is also provided a second helical flight 5 on the auger case which extends from the cutting end portion 3 at least partially toward the driven end portion 2 and, if desired, could extend for the entire length of the auger case. In the preferred embodiment, however, the second helical flight 5 extends for only one-half turn or 180° around the auger case. The first and second helical flights 4 and 5, respectively, have the same pitch so that there is no tendency for cuttings to clog between the auger flights.

At the upper end portion 2 of the auger case 1 there is provided a flange 6 welded thereto as indicated at 7. The flange 6 is provided with a plurality of holes 8 for receiving retaining screws or bolts.

At the extreme upper end of the apparatus there is provided a Kelly box flange 9 which is of generally square cross section. Kelly box flange 9 is welded as at 10 to end plate 11. End plate 11 in turn is welded as at 12 to cylindrical box 13 which is welded at 14 to flange 15. Flange 15 is provided with holes 16 which are aligned with holes 8 in flange 6 for receiving a retaining screw or bolt.

Kelly box flange 9 is adapted to receive a square Kelly bar 17 which is driven by a remote drilling rig (not shown). Kelly bar 17 is hollow as indicated at 18 for passage of compressed air to the pneumatic hammer or percussor positioned within the auger case. The Kelly bar 17 is secured in flange 9 by pins 19 and 20 extending through aligned holes 21 and 22 in flange 9 and Kelly bar 17, respectively. A rubber washer or seal 23 is provided between the end of Kelly bar 17 and end plate 11 to seal against leakage of compressed air. Plate 11 is provided with a hole 24 aligned with a hole 25 in washer 23 for admission of compressed air to the pneumatic percussor or hammer.

Flanges 15 and 6 are assembled, as shown, with holes 8 and 16 aligned and receiving hex-headed cap screws 26 secured by nuts 27. The flanges 6 and 15 are held tightly together and clamp in place the flange portion 28 of a top sub adapter 29. Top sub adapter 29 has a groove extending around flange 28 which receives an O-ring 30 for sealing the flange connection against compressed air leakage. Top sub adapter 29 is secured in place to hold the pneumatic percussor or hammer in the auger case 1.

A pneumatic percussor or hammer, generally indicated as 31, is positioned and secured inside auger case 1. The pneumatic hammer may be of any conventional type wherein compressed air is used to drive a hammer reciprocally to strike an anvil member which carries a rock cutting bit at its lower or cutting end. The particular pneumatic hammer used is not a critical feature of the invention and any of a variety of pneumatic hammers could be used in this apparatus provided the hammer case fits within the auger case and the top sub adapter is made to fit the threaded connection to the hammer case. In this apparatus, the upper end of the pneumatic hammer has a threaded connection (not shown) which is threaded into top sub adapter 29 which secures the hammer in place within the auger case.

The pneumatic percussor or hammer 31 is only partially illustrated. Pneumatic hammer 31 includes a hollow hammer case 32 in which there is positioned hammer piston 33 which is pneumatically actuated to reciprocate longitudinally of the hammer case 32. Hammer piston 33 is positioned to strike the anvil end 34 of reciprocally movable anvil member 35. Anvil member 35 is provided with longitudinally extending grooves 36 in which there are positioned cylindrical key members 37 which fit into grooves 38 in hammer drive sub 39. Hammer drive sub 39 is provided with threads 40 which provide a threaded connection to threads 41 inside the lower end of hammer case 32. The keys 37 (of which only one is shown) function to prevent rotation of reciprocally movable anvil member 35 during operation of the pneumatic hammer. Keys 37 insure that when hammer case 32 is rotated the reciprocally movable anvil member will rotate therewith. The air passages and valving for operation of pneumatically actuated hammer member 33 are not illustrated since they vary with different pneumatic hammer designs. However, most pneumatic hammers have an air exhaust through the anvil member as shown in FIG. 1. Reciprocally movable anvil member 35 has a longitudinal passageway 42 for discharge of compressed air. The compressed air discharge is necessary for the operation of the pneumatic hammer and provides the added function of assisting in the removal of cuttings from the hole being cut by the hammer.

The lower end of anvil member 35 is slightly enlarged as indicated at 43 and provides a shoulder 44 which abuts the lower end of hammer drive sub 39 and limits upward movement of the anvil member. Anvil member 35 has a stem portion 45 which extends below the lower end portion 3 of the auger case. A rigid bit member or bit plate 46 having a central aperture 47 is positioned on and supported by anvil member stem portion 45. Stem portion 45 is provided with a groove 48 aligned with a groove 49 in the aperture 47 of bit plate 46. A cylindrical or rod shaped key member 50 is positioned in grooves 48 and 49 and keys bit plate 46 to stem portion 45 so that bit plate 46 is restrained against rotary movement on stem 45. The lower end of anvil member stem portion 45 is threaded as indicated at 51. A pilot bit member 52 having an interior threaded opening or recess 53 is threaded on the threaded end portion of stem 45 and secures bit plate 46 tightly against shoulder 54 at the underside of the enlarged portion 43 of anvil member 35.

Pilot bit member 52 is constructed of hardened steel and is provided with a plurality of hard rock-cutting inserts 55, preferably of tungsten carbide or like material, which function to cut and crush rock or hard formations on impact. Pilot bit member 52 has a plurality of slots 56 cut around the periphery thereof which assist in the cutting function of the bit and also provide recesses for insertion of a bit breaker plate or a wrench for screwing or unscrewing the pilot bit on the threaded end portion 51 of anvil member 35. The bit breaker plate (not shown) is simply a metal plate having a recess cut with an opening and projections which fit over the pilot bit 52 with the projections extending into slots 56. Rotation of the breaker plate relative to anvil member 35 is effective to screw or unscrew the bit member into or out of operating position according to the direction of rotation of the bit breaker plate. Pilot bit member 52 is provided with a plurality of passages 57 which open into communication with passage 42 for discharge of compressed air from the pneumatic hammer.

Bit plate 46 is shown partially in section in FIG. 1 and is shown in more detail in FIGS. 3 – 6, inclusive. Bit plate 46 is a rigid member of hardened steel provided with a plurality of hard rock-cutting inserts 58 which are preferably of tungsten carbide or like material. Bit plate 46 is elongated in shape and has a central portion 59 which is partially circular in shape and outer end portions 60 and 61 which are in the form of segments of a larger circle. Bit plate 46 is provided with longitudinally extending passage 62 and vertically extending passages 63 which communicate with the compressed air exhaust passage from the anvil member for exhausting compressed air to assist in removal of cuttings. The outer edges of bit plate 46 are provided with slots or grooves 64. The bit plate 46 has edges 65 and 66 which are square with the surface of the plate and adapted to be driven by the auger flights. At the opposite side of bit plate 46 the edges 67 and 68 are inclined to form a cutting edge with an inclined surface adapted to direct earth and rock cuttings to the upper surface of the bit plate to be conveyed away by the helical flights of the auger.

Bit plate 46 is arranged to be driven by the flights on the rotary auger. The partial flight 5 terminates in a downwardly extending flange 69 welded thereon and having a vertically extending slot 70 therein. There are also provided a pair of reinforcing ribs 71 and 72 which are at least partially helical in shape and are welded to the underside of flight 5 and to flange 69 to reinforce flight 5 and flange 69 for driving bit plate 46 in rotary motion. Edge portion 65 of bit plate 46 is provided with a threaded aperture 73 in which there is secured a cap screw 74 extending through slot 70 and holding the slotted flange 69 loosely against the edge 65. On the other side of the auger, flight 4 terminates in a downwardly extending flange or drive plate 75 having a slot 76 and supported by reinforcing ribs 77 and 78, all of which are welded to the bottom of flight 4. The flat surface 66 of bit plate 46 is provided with a threaded aperture 78 in which there is secured a hex-headed cap screw 79 which extends through slot 76 and holds flange or drive plate 75 loosely against surface 76. The hex-headed cap screws 74 and 79 function to hold the slotted drive plates 69 and 75 loosely against surfaces 65 and 66 of bit plate 46 and permit movement of bit plate 46 longitudinally of slots 70 and 76.

OPERATION

The foregoing description of the assembly of this apparatus and the function of the various parts have given a partial description of the operation of the apparatus and the functions of the various elements of construction. However, the following description of operation will assist one skilled in the art to understand the operation and the purpose of this apparatus.

As noted above, this apparatus is intended for use in rocky or hard or heterogenous formations and utilizes the pneumatic percussor or pneumatic hammer to break through the rocks or hard formation and utilizes the auger to remove cuttings and debris in cutting through the formation. In soft formations the pneumatic percussor assists in the operation of the auger to accelerate removal of softer material. When harder formations are encountered the pneumatic percussor or pneumatic hammer is operated to break up the rock or hard formation and permit the auger flights to conduct the cuttings away.

The apparatus is rotated by a Kelly bar 17 which is operated by a rotary drilling rig of conventional design which is not shown. The Kelly bar 17 is hollow in construction and conducts compressed air to the pneumatic percussor or pneumatic hammer 31 to operate the pneumatically actuated hammer to drive the anvil member 35 and the bit plate 46 and pilot bit 52 to cut into the rock or other hard formation. The pneumatic hammer apparatus is an integral unit of conventional construction and is replaceably secured within the auger case 1 with its upper end being threadly held in the sub 29. Pneumatic hammer member 33 is operated by compressed air to drive the same up and down against the anvil end of anvil member 35 while the auger is being rotated by Kelly 17. The key 37 prevents rotation of anvil member 35 relative to the hammer case. The bit plate 46 is connected to slotted drive plates 69 and 75 which drive the bit member 46 through rotary movement along with the auger and cause the pilot bit 52 to rotate therewith by reason of the keyed connection between bit plate 46 and the stem portion of anvil member 35. As the auger rotates and anvil member 35 is moved by the pounding of pneumatically actuated hammer member 33 the bit plate 46 and pilot bit 52 break up any rock or hard formation encountered. The cuttings are conveyed along the inclined surfaces 67 and 68 of bit plate 46 and along the upper surface thereof to the lower extreme edges of auger flights 4 and 5. At that point, the cuttings are conveyed up the auger for removal away from the zone of drilling. The compressed air escaping from the pneumatic percussor or pneumatic hammer blows around the lower end through the various exhaust passageways and assists in removing the cuttings and directing the same upward to be picked up by the inclined surfaces 67 and 68 of bit plate 46 and auger flights 4 and 5.

This combined pneumatic hammer and auger has a substantial advantage in that it can drill through soft or hard or heterogenous formations. The construction is such that the torque transmitted to bit plate 46 is transmitted entirely at the outer portion by means of thrust plates or flanges 69 and 75 respectively. In this arrangement there is a further advantage that the bits can be changed without the necessity of disturbing the pneumatic hammer. The bits may be removed by merely reversing the rotation of the Kelly bar while holding the pilot bit with a bit breaker plate as previously described. This allows the pilot bit to be unscrewed and the bit plate 46 is readily removed since it is not held by any threads. In this apparatus the entire torque of the rotary drilling operation is taken by the auger case and the auger flighting and there is no high drilling torque applied to the joints connected to the pneumatic hammer. It is therefore apparent that servicing of the hammer is also easier to accomplish since the hammer joints have not been subjected to the high drilling torque.

While this invention has been described with special emphasis upon a single preferred embodiment, it will be obvious to those skilled in the art that within the scope of the appended claims the invention may be practiced otherwise than as specifically described herein.

I claim:

1. a percussion and rotary auger earth boring apparatus comprising:

a rotatable earth boring auger having a hollow case, said auger case having a driven end, including means adapted for connection to an external rotary driving means, and a cutting end, a first helical flight secured on said auger case extending helically from said cutting end substantially to said driven end, a second helical flight secured on said auger case and extending at least partially from said cutting end towards said driven end at substantially the same pitch as said first flight, said flights terminating at said cutting end in edges substantially aligned on opposite sides of said auger case, a pneumatic percussor positioned removably within said auger case, said percussor having a case enclosing a reciprocally movable pneumatically actuated hammer operable to strike an anvil member positioned therein for longitudinal movement, said anvil member having a stem portion extending outside the cutting end of said auger case, a rigid rock cutting bit member secured on said stem portion and extending across the entire diameter of said flights and movable therewith and having an upper surface directing cuttings on to said flights, and means secured at the cutting end edges of said flights and operatively engaging said bit member whereby rotation of said auger effects rotation of said bit member while said hammer effects percussive movement thereof.

2. An earth boring apparatus according to claim 1 in which said bit member is positioned for movement along the cutting end portion of said flights and has an upper surface directing movement of cuttings on to said flights.

3. An earth boring apparatus according to claim 2 in which said bit member is provided with a plurality of hard rock-cutting inserts in the cutting surface thereof.

4. An earth boring apparatus according to claim 2 in which said bit member has inclined faces providing earth cutting edges directing cuttings onto the upper surfaces thereof for removal by said auger flights.

5. An earth boring apparatus according to claim 2 in which a smaller rock-cutting pilot bit is secured on said stem portion and holding said bit member in position.

6. An earth boring apparatus according to claim 2 in which said bit member and stem portion are provided with a key preventing relative rotary motion therebetween.

7. An earth boring apparatus according to claim 2 in which each of said flights includes a downwardly extending slotted flange and reinforcing ribs extending backwardly therefrom along the underside thereof, said flanges engaging opposite end portions of said bit member, and screw members secured through the slots in said flanges into said bit member to hold the same loosely together while permitting movement of said bit member longitudinally of the slots.

8. An earth boring apparatus according to claim 7 in which said anvil member, bit member, and pilot bit are provided with intersecting passageways for exhausting compressed air from said pneumatic percussor assisting in the removal of cuttings.

9. An earth boring apparatus according to claim 1 in which auger case driven end includes a recepticle for a rotary Kelly bar.

10. An earth boring apparatus according to claim 9 in which said recepticle includes an inlet passageway for supplying compressed air to said pneumatic percussor for operating the hammer thereof.

* * * * *